United States Patent [19]

Ivey

[11] Patent Number: 5,021,932

[45] Date of Patent: Jun. 4, 1991

[54] SAFETY DEVICE FOR COMBINED VENTILATOR/LIGHT UNIT

[75] Inventor: Charles W. Ivey, Hope Mills, N.C.

[73] Assignee: Fasco Industries, Inc., Lake Forest, Ill.

[21] Appl. No.: 352,895

[22] Filed: May 17, 1989

[51] Int. Cl.[5] ..... F21V 33/00

[52] U.S. Cl. ..... 362/96; 362/373

[58] Field of Search ..... 362/96, 373, 294; 34/87; 98/40.07, 40.08

[56] References Cited

U.S. PATENT DOCUMENTS

| | | | |
|---|---|---|---|
| 3,786,233 | 1/1974 | Bumpus et al. | 98/40.07 |
| 3,909,589 | 9/1975 | Stone et al. | 362/96 |
| 3,958,100 | 5/1976 | Stone | 362/96 |
| 4,450,512 | 5/1984 | Kustofek | 362/373 |
| 4,453,202 | 6/1984 | Morris et al. | 362/375 |
| 4,748,900 | 6/1988 | Swin, Sr. et al. | 98/40.07 |
| 4,827,386 | 5/1989 | Mackiewicz | 362/373 |

*Primary Examiner*—Ira S. Lazarus

*Assistant Examiner*—Sue Hagarman

*Attorney, Agent, or Firm*—Shlesinger, Fitzsimmons, Shlesinger

[57] ABSTRACT

Two thermal protectors or thermostatic sitches are mounted on the outside of the housing of a combination ventilator/lamp unit to sense any heat build-up in the housing during operation of its lamp. One switch is normally open and is connected between the lamp and the motor for the ventilator fan; and the other switch, which is normally closed, is connected in series with the fan motor and lamp. The normally open switch is set to close automatically when the temperature in the housing reaches a first value above room temperature, thereby to energize the fan motor to cool down the housing. If the normally open switch and/or the fan motor fails the normally closed switch is set to open at a temperature above that at which the normally open switch closes, and functions as a safety switch to disconnect both the fan motor and lamp from the power supply.

2 Claims, 2 Drawing Sheets

SAFETY DEVICE FOR COMBINED VENTILATOR/LIGHT UNIT

BACKGROUND OF THE INVENTION

This invention relates to a combined ventilator and light unit, and more particularly to a safety device for preventing the overheating of a ventilator/light unit of the type that is particularly suited for residential bathroom use.

A combination ventilator/light unit of the type described normally incorporates an electric fan for exhausting air from a bathroom, or the like, and a lamp which is operable independently of the fan. Underwriters Laboratories, Inc., Standard 507 (electric fans), which sets the industry guidelines for bathroom ceiling ventilator safety devices, has for years permitted such incorporation of a light compartment in a bathroom ventilator. With the current awareness of a need for conserving energy, however, many new homes are now heavily insulated, particularly in the ceiling areas. Because of this increased insulation, there appears to be a substantially greater danger of undesirable heat build-up in units of the type described.

In order to improve the operational safety of residential bathroom ventilator/light combinations of the type described, it is clear that some means must be provided for accurately sensing and avoiding excessive heat build-up in units of the type described.

It is an object of this invention, therefore, to provide for combined ventilator/light units of the type described a system or device for sensing and preventing undesirable heat build-up in such units.

It is further object of this invention to provide for combined ventilator/light units of the type described a novel heat sensing and control circuit which includes a pair of heat sensors, at least one of which makes use of the ventilator portion of the unit automatically to prevent any undesirable heat build-up in the unit.

Still another object of this invention is to provide a novel safety device of the type described which is mounted on the ventilator/lamp housing in such manner that it is substantially tamper proof when being installed.

Other objects of the invention will be apparent hereinafter from the specification and from the recital of the appended claims, particularly when read in conjunction with the accompanying drawings.

SUMMARY OF THE INVENTION

The ventilator/light unit includes a metal housing containing in its lower end an incandescent lamp socket, and in its upper end a ventilating or exhaust fan and its associated motor. Mounted beneath a removable casing on the outside of the housing to open on the interior of the housing above the lamp socket, and beneath the fan, are two plugs for receiving the wire leads from the lamp and fan motor, respectively, and a pair of thermal protectors, or temperature limiting switches one of which is normally open, and the other of which is normally closed. The fan motor and lamp socket are connected in parallel to the power supply through separate, manually-operated switches, so that they may be operated independently of one another under normal conditions.

The normally open thermostatic switch does not normally affect the operation of either the lamp or the fan motor. However, whenever it senses an excessive heat build-up in the housing during operation of the lamp, it automatically closes and connects the fan motor to the power supply through the manually-operated switch which is used to supply power to the lamp. The second, or backup thermal protector, which is normally closed, is connected in series with both the fan motor and lamp, and is set to open at a temperature above the operating temperature of the normally open switch, but below any unacceptable high temperature. In the event of any malfunction of the normally open thermostatic switch, or the fan, the second thermal protector will shut down both the lamp and fan motor until the unit cools to a satisfactory temperature.

By mounting the two plugs and the thermostatic switches on the outside of the housing, they are sheltered from any tampering, accidental or otherwise, when the unit is finally installed in a bathroom ceiling or the like.

THE DRAWINGS

DETAILED DESCRIPTION OF THE PREFERRED EMBODIMENTS

Figure 1:
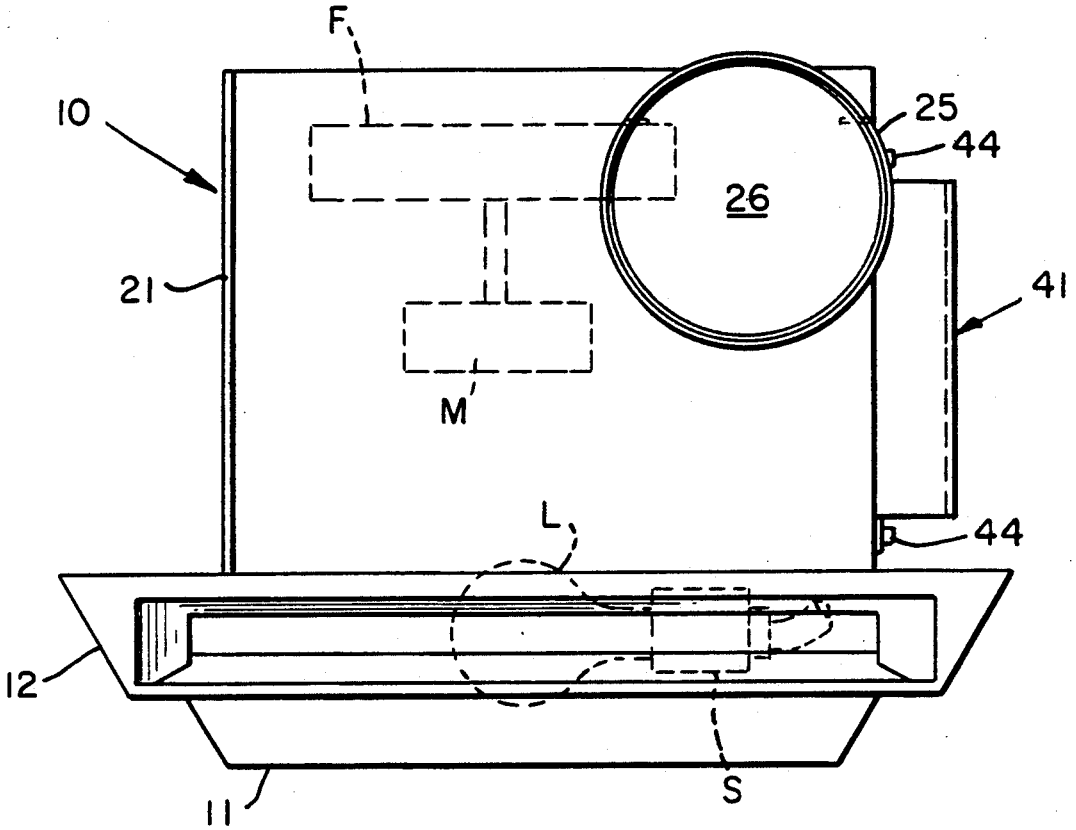
FIG. 1 is a front elevational view of a combination light/ventilator unit made according to one embodiment of this invention.

Referring now to the drawings by numerals of reference, 10 denotes generally a rectangular, metal housing having removably mounted on the lower end thereof a lamp, reflector and grille assembly, which may be similar to that of the type disclosed in the pending U.S. patent application Ser. No. 07/308,086, which was filed by me and others as joint inventors on Feb. 9, 1989, and which is assigned to the same assignee as the instant application. Application Ser. No. 07/308,086 was granted Aug. 29, 1989 as U.S. Pat. No. 4,862,334. This assembly includes a translucent lens 11, a grille 12, and a reflector (not illustrated) which are removably mounted on the lower end of housing 10 by means which form no part of this invention. The reflector portion of the assembly includes a conventional lamp socket S (broken lines in FIGS. 1 and 2) in which a conventional bulb or lamp L (broken lines in FIGS. 1 and 2) is adapted to be mounted to direct light, when illuminated, downwardly through the lens 11. Mounted in the upper end of housing 10, also by means which form no part of this invention, are a conventional exhaust or ventilator fan F and its associated electric motor M, both of which are illustrated in phantom by broken lines in FIG. 1.

Integral with and projecting laterally beyond the opposed side edges of one of the walls of housing 10 (the left hand wall as shown in FIG. 1) are two mounting flanges 21 and 22, each of which has therein an opening 23 for accommodating either screws or nails that can be used for securing housing 10 to one side of a joist in the ceiling of, for example, a residential bathroom ceiling. Secured to one of the upper corners of the housing 10 (the upper right hand corner shown in FIG. 1), and communicating with the interior of the housing is a cylindrical duct 25, which is adapted to be connected in known manner by additional ducting (not illustrated) to the exterior of the house in which the unit is mounted. Pivotally mounted in conventional manner in the bore of duct 25 is a flap valve 26, which is normally closed, but which will open when the fan F is operated to exhaust air from the room in which the unit is mounted.

Figure 2:
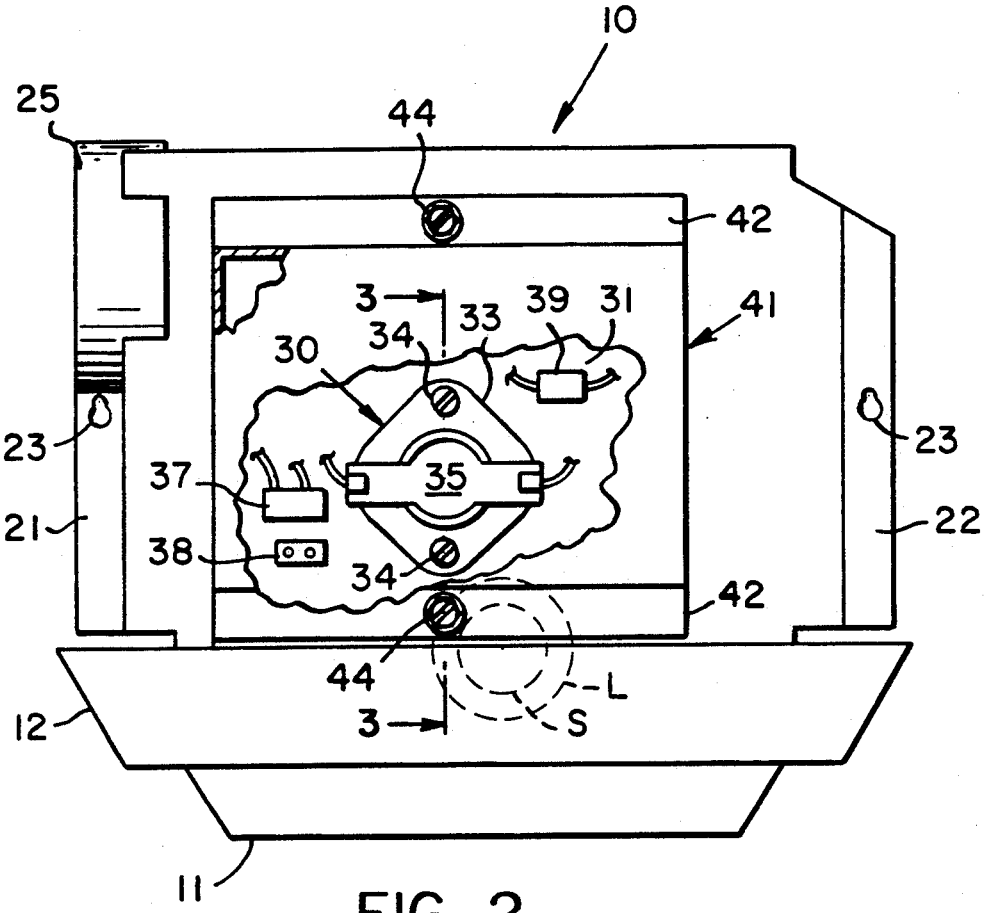
FIG. 2 is a side elevational view of this unit, as seen when looking at the right side of the unit as shown in FIG. 1, and with portions thereof cut away for purposes of illustration.
Figure 3:
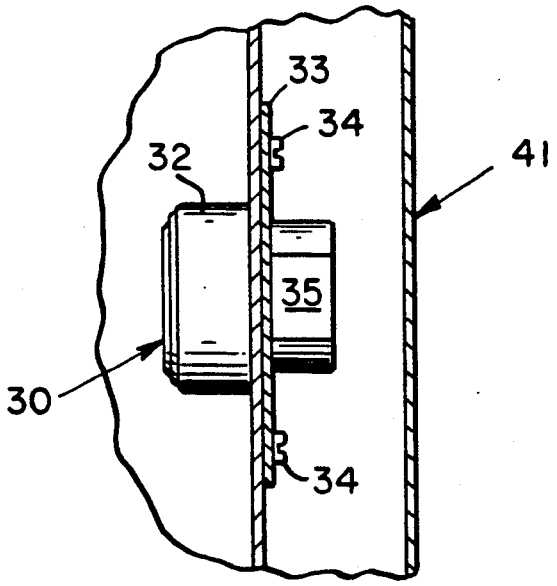
FIG. 3 is an enlarged, fragmentary sectional view taken generally along the line 3—3 in FIG. 2 looking in the direction of the arrows.

Referring now to FIGS. 2 and 3, 30 denotes generally a first thermostat, which is mounted substantially centrally of the housing wall 31, which is remote from the wall that has the flanged projections 21 and 22. In the embodiment illustrated, thermostat 30 comprises a metallic, generally can-shaped housing having a closed, cylindrically shaped end 32, which, projects into the housing 10 through a registering, circular opening in wall 31, and which has on the opposite end thereof an integral, laterally projecting flange 33 that is secured against the outer surface of wall 31 by a pair of screws 34. Secured in the thermostat housing, and projecting out of the open end thereof beyond the flange 33, is the conventional wiring terminal 35, which is used for connecting the switch 30-1 (FIG. 4) in thermostat 30 in the circuit described hereinafter.

Mounted in two other openings in the housing wall 31 adjacent thermostat 30 are two, conventional plug receptacles 37 and 38, which open at their inner ends on the inside of housing 10 in order to permit leads from the fan motor M and lamp socket S to be connected removably thereto in a conventional manner. Also, staked or otherwise secured to the outside surface of wall 31 adjacent the first thermostat 30, is a second thermostat or thermal protector 39 containing a switch 39-1 (FIG. 4) which is described in greater detail hereinafter.

In order to prevent undesirable tampering with the wires leading from the thermostats 30 and 39, and the receptacles 37 and 38, these items are covered at the exterior wall 31 by a shallow, generally rectangularly shaped cover or casing 41, which has extending along opposite sides thereof narrow flange sections 42 that are secured to the outer surface of wall 31 by screws 44.

Figure 4:
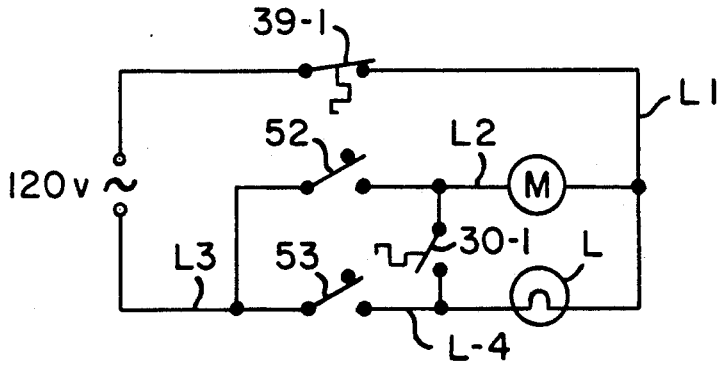
FIG. 4 is a wiring diagram illustrating schematically one manner in which the various components of the unit can be wired for operation.

Referring now to FIG. 4, the thermostatic switch 39-1 is normally closed, and is adapted to be connected at one side to one side of a conventional 120 volt power supply, and at its opposite side by a line L1 to one side of the motor winding of motor M, and to one side of the lamp L. The opposite side of the motor winding is connected by a line L2 to one side of a conventional, manually-operated wall switch 52, the opposite side of which is connected by a line L3 to the opposite side of the 120 volt power supply. Also, the opposite side of the lamp L is connected by line L4 to one side of another, manually-operated switch 53, the opposite side of which is also connected by line L3 to the opposite side of the power supply. In essence, therefore, the motor winding for motor M, and the lamp L, are connected in parallel with each other across the power supply, and in series with the thermal protector switch 39-1. Also, the switches 52 and 53 are connected in parallel with each other, and in series with, respectively, the winding of motor M and the lamp L, so that these switches can be operated manually and selectively to energize the motor M or the lamp L through switch 39-1.

After the lamp L has been illuminated for a rather long period of time, it will generate in housing 10 a substantial amount of heat, particularly if the ventilating fan F is not operating. To prevent an undesirable accumulation of heat, the normally-open switch 30-1 in the thermostat 30 is connected between lines L2 and L4, so that when the temperature within the housing 10 reaches a predetermined first value, the switch 30-1 will automatically close, thereby connecting both the winding of motor M and the lamp L to the power supply through the switch 53. Hence, if at this time the switch 53 is closed, then both the motor and the lamp will be energized simultaneously. As soon as the motor begins to operate the fan F, the temperature within the housing 10 will begin to drop; and when the temperature falls below the first predetermined value for which the thermostat 30 has been set, then switch 30-1 will automatically reopen and deenergize the motor M, assuming that the switch 52 is at that time in its open position.

The other, normally closed thermostatic switch 39-1, on the other hand is set automatically to open and operatively to disconnect both the mother M and lamp L from the power source whenever, through failure of switch 30-1 or motor M, the heat in housing 10 builds up to a maximum allowable temperature above that for which switch 30-1 is set to close. Switch 39-1 therefore functions as a second or backup safety switch which shuts down the complete unit should the first protector 30-1 (or motor M) fail.

From the foregoing it will be apparent that the present invention provides a relatively simple, inexpensive means for preventing any undesirable overheating of the combination ventilator/lamp disclosed herein. The circuitry is compact, and can be enclosed beneath the cover or casing 41, so that the circuit can be wired at the time that the unit is manufactured. Thereafter, upon access to the interior of the housing 10, for example upon removal of the assembly 11, 12, the lamp and fan motor leads, if desired, can be removed, simply by unplugging them from the receptacles 37 and 38. At such time, however, the wiring terminals for the thermostats 30 and 39 will be located at the exterior of housing 10, and beneath the cover 41, so that no undesirable or accidental tampering with those leads will occur at such time.

Although thermostat 30 has been shown to be of the type which projects into housing 10, it will be readily apparent that it could be designed, if desired, simply to overlie an opening in the housing in which case it would still sense the temperature therein. Moreover, while the invention has been illustrated and described in detail herein in connection with only certain embodiments thereof, it will be apparent that it is capable of still further modification, and that this application is intended to cover any such modifications that may fall within the scope of one skilled in the art or the appended claims.

I claim:

1. A safety device for a combination ventilator/light unit of the type having a housing containing in its lower end a lamp, and in its upper end a ventilator fan and electric motor therefor, comprising a first normally closed, temperature responsive switch mounted on said housing, means for connecting said first switch across a power supply in series with said lamp and said motor, and operative automatically to disconnect both said lamp and said motor from said power supply when the temperature in said housing exceeds a first predetermined value, a second, normally open, temperature responsive switch mounted on said housing in communication with the interior thereof between said lamp and said fan to sense the temperature in said housing adjacent said lamp, means connecting said second switch between said fan motor and said lamp, said second switch being operative, when said lamp is energized, automatically to close and energize said fan motor when the temperature in said housing exceeds a second predetermined value lower than said first predetermined value, said second switch comprising a thermostat mounted in a metal container extending at one end through a hole in one exterior wall of said housing and having thereon on its opposite end a mounting flange secured against the outside surface of said one exterior wall of said housing, said one end of said container being closed to prevent access to the wire leads of said thermostat from the interior of said housing, a pair of wire plug receptacles mounted in said one wall of said housing adjacent said thermostat, and a cover removably secured to said outside surface of said one wall of said housing and overlying and covering said thermostat and said plugs.

2. In the combination of a combined ventilator/light unit of the type having a housing containing in one end thereof a lamp and in its opposite end an exhaust fan and electric motor for driving said fan, and a circuit including a pair of mutually operable switches connected in series with said lamp and said fan motor, respectively, and operable selectively to connect said fan and said motor to a power source for selective operation of the lamp and motor independently of each other, means for preventing undesirable overheating of the housing, comprising first heat sensing means mounted intermediate its ends in an opening in one external wall of said housing to extend at one end externally of said housing, and to extend at its opposite end into said housing between said lamp and said motor, said first sensing means including a temperature responsive, normally open switch connected to said lamp and said motor, and operable, when closed, to supply power to each of said lamp and said motor through one of said manually operable switches when the latter is closed, and second heat sensing means mounted on said one wall of said housing and including a normally closed, temperature responsive switch connected in series with said lamp and said motor, said normally open switch being set automatically to close when the temperature in said housing between said lamp and said motor reaches a first predetermined temperature above room temperature, and said normally closed switch being set to open when the temperature in said housing between said lamp and said motor exceeds said first predetermined temperature.

* * * * *